US007101037B2

(12) United States Patent
Mihara et al.

(10) Patent No.: US 7,101,037 B2
(45) Date of Patent: Sep. 5, 2006

(54) IMAGE RECORDING DEVICE

(75) Inventors: Akira Mihara, Ebina (JP); Kenichi Kawauchi, Ebina (JP); Satoshi Mohri, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 11/068,425

(22) Filed: Feb. 28, 2005

(65) Prior Publication Data

US 2006/0050125 A1 Mar. 9, 2006

(30) Foreign Application Priority Data

Sep. 9, 2004 (JP) ..... 2004-262580

(51) Int. Cl.
*B41J 2/001* (2006.01)

(52) U.S. Cl. ..... 347/104; 101/407.1; 101/409; 271/3.21

(58) Field of Classification Search ..... None
See application file for complete search history.

(56) References Cited

U.S. PATENT DOCUMENTS 3,096,709 A * 7/1963 Eldred et al. ..... 101/115
5,198,242 A * 3/1993 Groeblacher et al. ..... 425/150
6,385,431 B1 * 5/2002 Arcaro et al. ..... 399/381

FOREIGN PATENT DOCUMENTS

JP 10-193581 7/1998
JP 2002-283629 10/2002

* cited by examiner

*Primary Examiner*—Andrew H. Hirshfeld
*Assistant Examiner*—Jill E. Culler
(74) *Attorney, Agent, or Firm*—Fildes & Outland, P.C.

(57) ABSTRACT

An image recording device includes plural retaining units each of which retains a recording medium on circumference thereof, a printing head that forms an image on the recording medium, a loop unit that retains the plural retaining units on a closed path, a first driving unit that drives each of the plural retaining units, and a second driving unit that conveys the retaining units on the loop unit, wherein when the first driving unit drives one of the plural retaining units to form an image on a first recording medium retained on circumference thereof, the first driving unit drives another one of the retaining units to mount a second recording medium on circumference thereof, and the second driving unit conveys one of the retaining units to a recording medium peeling position after completing image formation, and another one of the retaining units to a printing position.

4 Claims, 10 Drawing Sheets

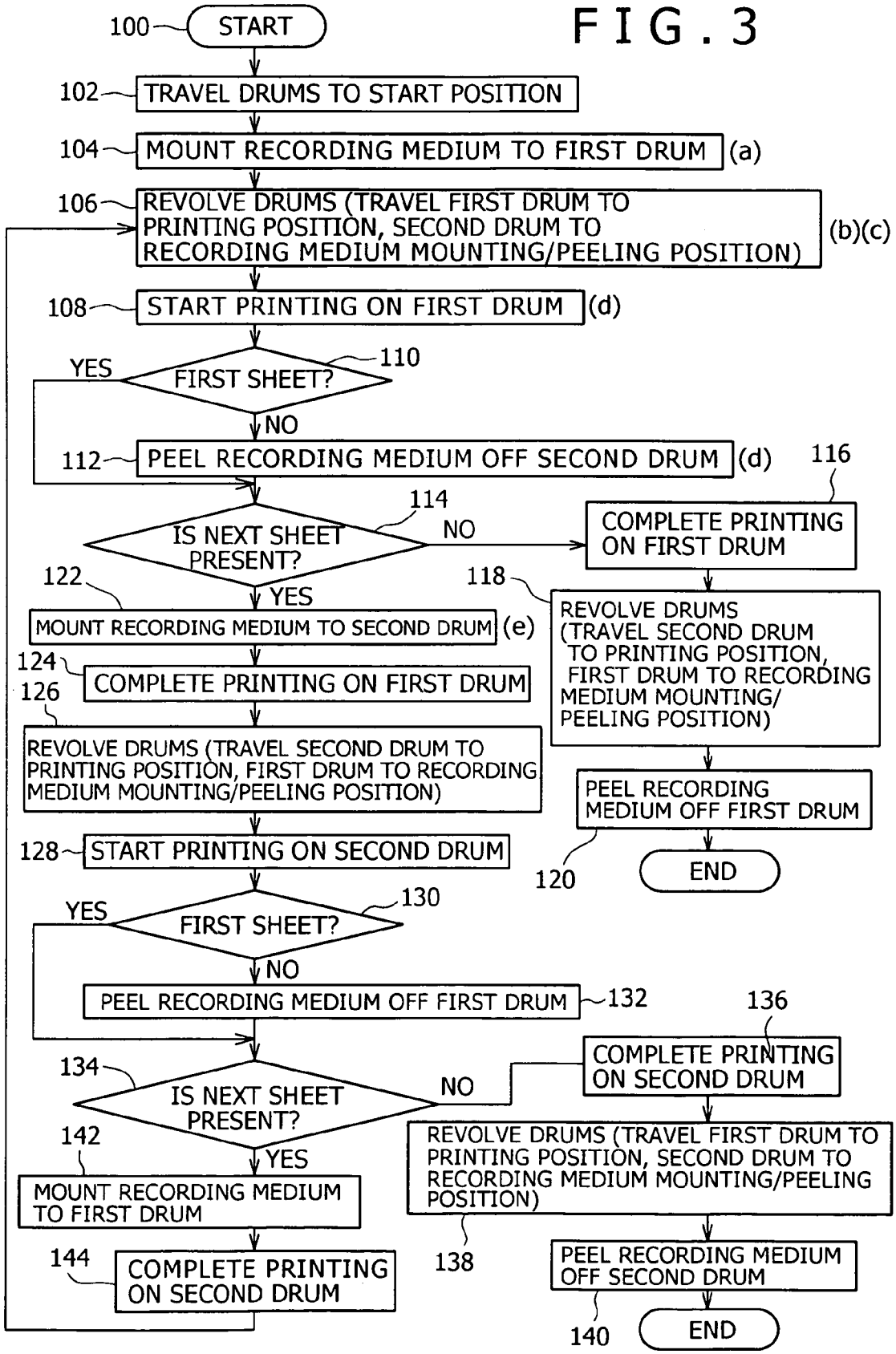
FIG. 3
100
START
102
TRAVEL DRUMS TO START POSITION
104
MOUNT RECORDING MEDIUM TO FIRST DRUM
(a)
106
REVOLVE DRUMS (TRAVEL FIRST DRUM TO PRINTING POSITION, SECOND DRUM TO RECORDING MEDIUM MOUNTING/PEELING POSITION)
(b)(c)
108
START PRINTING ON FIRST DRUM
(d)
110
FIRST SHEET?
YES
NO
112
PEEL RECORDING MEDIUM OFF SECOND DRUM
(d)
114
IS NEXT SHEET PRESENT?
NO
YES
116
COMPLETE PRINTING ON FIRST DRUM
118
REVOLVE DRUMS (TRAVEL SECOND DRUM TO PRINTING POSITION, FIRST DRUM TO RECORDING MEDIUM MOUNTING/ PEELING POSITION)
PEEL RECORDING MEDIUM OFF FIRST DRUM
120
END
122
MOUNT RECORDING MEDIUM TO SECOND DRUM
(e)
124
COMPLETE PRINTING ON FIRST DRUM
126
REVOLVE DRUMS (TRAVEL SECOND DRUM TO PRINTING POSITION, FIRST DRUM TO RECORDING MEDIUM MOUNTING/PEELING POSITION)
128
START PRINTING ON SECOND DRUM
130
FIRST SHEET?
YES
NO
PEEL RECORDING MEDIUM OFF FIRST DRUM
132
134
IS NEXT SHEET PRESENT?
NO
YES
136
COMPLETE PRINTING ON SECOND DRUM
REVOLVE DRUMS (TRAVEL FIRST DRUM TO PRINTING POSITION, SECOND DRUM TO RECORDING MEDIUM MOUNTING/PEELING POSITION)
138
PEEL RECORDING MEDIUM OFF SECOND DRUM
140
END
142
MOUNT RECORDING MEDIUM TO FIRST DRUM
144
COMPLETE PRINTING ON SECOND DRUM

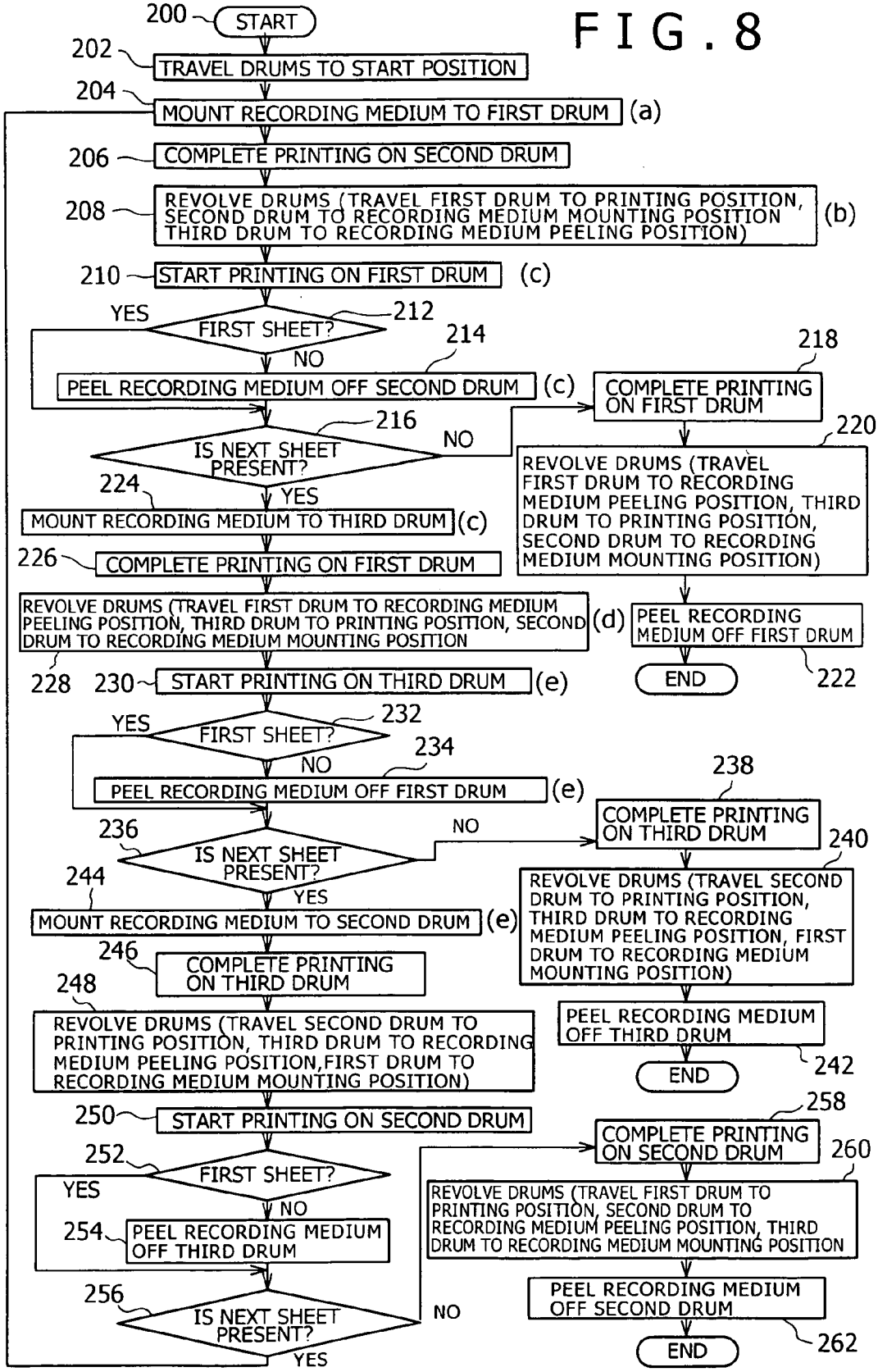
FIG. 8
200 START
202 TRAVEL DRUMS TO START POSITION
204 MOUNT RECORDING MEDIUM TO FIRST DRUM (a)
206 COMPLETE PRINTING ON SECOND DRUM
208 REVOLVE DRUMS (TRAVEL FIRST DRUM TO PRINTING POSITION, SECOND DRUM TO RECORDING MEDIUM MOUNTING POSITION THIRD DRUM TO RECORDING MEDIUM PEELING POSITION) (b)
210 START PRINTING ON FIRST DRUM (c)
212 FIRST SHEET?
YES
NO
214 PEEL RECORDING MEDIUM OFF SECOND DRUM (c)
216 IS NEXT SHEET PRESENT?
NO
YES
218 COMPLETE PRINTING ON FIRST DRUM
220 REVOLVE DRUMS (TRAVEL FIRST DRUM TO RECORDING MEDIUM PEELING POSITION, THIRD DRUM TO PRINTING POSITION, SECOND DRUM TO RECORDING MEDIUM MOUNTING POSITION)
222 PEEL RECORDING MEDIUM OFF FIRST DRUM
END
224 MOUNT RECORDING MEDIUM TO THIRD DRUM (c)
226 COMPLETE PRINTING ON FIRST DRUM
228 REVOLVE DRUMS (TRAVEL FIRST DRUM TO RECORDING MEDIUM PEELING POSITION, THIRD DRUM TO PRINTING POSITION, SECOND DRUM TO RECORDING MEDIUM MOUNTING POSITION (d)
230 START PRINTING ON THIRD DRUM (e)
232 FIRST SHEET?
YES
NO
234 PEEL RECORDING MEDIUM OFF FIRST DRUM (e)
236 IS NEXT SHEET PRESENT?
NO
YES
238 COMPLETE PRINTING ON THIRD DRUM
240 REVOLVE DRUMS (TRAVEL SECOND DRUM TO PRINTING POSITION, THIRD DRUM TO RECORDING MEDIUM PEELING POSITION, FIRST DRUM TO RECORDING MEDIUM MOUNTING POSITION)
242 PEEL RECORDING MEDIUM OFF THIRD DRUM
END
244 MOUNT RECORDING MEDIUM TO SECOND DRUM (e)
246 COMPLETE PRINTING ON THIRD DRUM
248 REVOLVE DRUMS (TRAVEL SECOND DRUM TO PRINTING POSITION, THIRD DRUM TO RECORDING MEDIUM PEELING POSITION,FIRST DRUM TO RECORDING MEDIUM MOUNTING POSITION)
250 START PRINTING ON SECOND DRUM
252 FIRST SHEET?
YES
NO
254 PEEL RECORDING MEDIUM OFF THIRD DRUM
256 IS NEXT SHEET PRESENT?
NO
YES
258 COMPLETE PRINTING ON SECOND DRUM
260 REVOLVE DRUMS (TRAVEL FIRST DRUM TO PRINTING POSITION, SECOND DRUM TO RECORDING MEDIUM PEELING POSITION, THIRD DRUM TO RECORDING MEDIUM MOUNTING POSITION
262 PEEL RECORDING MEDIUM OFF SECOND DRUM
END

IMAGE RECORDING DEVICE

BACKGROUND OF THE INVENTION

1. Field of the Invention

The present invention relates to an image recording device.

2. Description of the Related Art

A printer using the so-called FWA (Full Width Array) ink-jet recording head that covers the width of recording medium is capable of enhancing a printing speed remarkably, compared to the so-called serial ink-jet printer, because it does not scan the print head back and forth. Therefore, the printer is suitable for mass continuous printing. Also the printer is capable of reducing the device size significantly, compared to the so-called laser printer using toner, because the structure of the printer is simple.

A drum-type printer 400 as shown in FIG. 12, for example, completes printing when an ink-jet recording head 404 scans one rotation in the rotating direction of a drum 402 (when the drum 402 makes one rotation with paper P wound thereon); therefore, the printer 400 is capable of high-speed printing, compared to the serial type printer, which does not complete printing until making several reciprocating scans of the ink-jet recording head 404 in the direction perpendicular to the transferring direction of the paper P. The printing speed of the drum-type printer 400 depends on the rotating speed of the drum 402; accordingly, the printing speed is enhanced theoretically as the rotating speed of the drum 402 is increased.

However, the drum-type printer as such involves a time loss while mounting/peeling the paper P on/from the drum, and the actual performance cannot be enhanced in proportion to increasing the rotating speed of the drum.

Increasing the rotating speed of the drum and mounting the paper at a high speed are likely to create dislocations and/or vibrations of the paper retained on the circumference of the drum. If this happens, it will dislocate the point of impact of the ink drops ejected from the ink-jet recording head and adhere the ink drops at dislocated positions on the paper, which will deteriorate the printing quality to a great extent and create a possibility of quality deficiencies.

To deal with this problem, a construction has been proposed which performs to divide a series of operations of mounting, printing, and peeling-off of printing paper by one rotation during the rotation of the drum (refer to, for example, Japanese Published Unexamined Patent Application No. Hei 10-193581 (FIG. 1, pp. 3 to 5)).

The above method performs paper mounting and peeling separately from printing to attain a stable operation, but it takes extra time for that operation. Naturally, the throughput capacity will be deteriorated during continuous printing because the printing is impossible during paper mounting and peeling.

Another construction has been proposed which prepares a high speed and a low speed as the rotating speed of the drum, and controls the rotating speed of the drum to the low speed when mounting the paper on the drum and to the high speed when performing printing on the paper mounted on the drum (refer to, for example, Japanese Published Unexamined Patent Application No. 2002-283629 (FIG. 3, pp. 3 to 4)).

This method only lowers the rotating speed of the drum without stopping the rotation during mounting the paper; therefore, the drum itself is driven without stopping the rotation, however this method does not deal with the lowering of the processing speed.

SUMMARY OF THE INVENTION

The present invention has been made in view of the above circumstances and provides an FWA ink-jet image recording device that performs high-speed printing with stable printing quality.

According to an embodiment of the invention, the image recording device includes plural retaining units each of which retains a recording medium on circumferences thereof, a printing head that forms an image on the recording medium, a loop unit that retains the plural retaining units on a closed path, a first driving unit that drives each of the plural retaining units, and a second driving unit that conveys the retaining units on the loop unit. When the first driving unit drives one of the plural retaining units to form an image on a first recording medium retained on circumference thereof, the first driving unit drives another one of the retaining units to mount a second recording medium on circumference thereof, and the second driving unit conveys one of the retaining units to a recording medium peeling position after completing image formation, and another one of the retaining units to a printing position.

BRIEF DESCRIPTION OF THE DRAWINGS

Embodiments of the present invention will be described in detail based on the following figures, wherein:

FIG. 3 is a flowchart illustrating the operation of the image forming device according to the first embodiment of the present invention;

FIG. 8 is a flowchart illustrating the operation of the image forming device according to the third embodiment of the present invention;

DETAILED DESCRIPTION OF THE INVENTION

Figure 1:
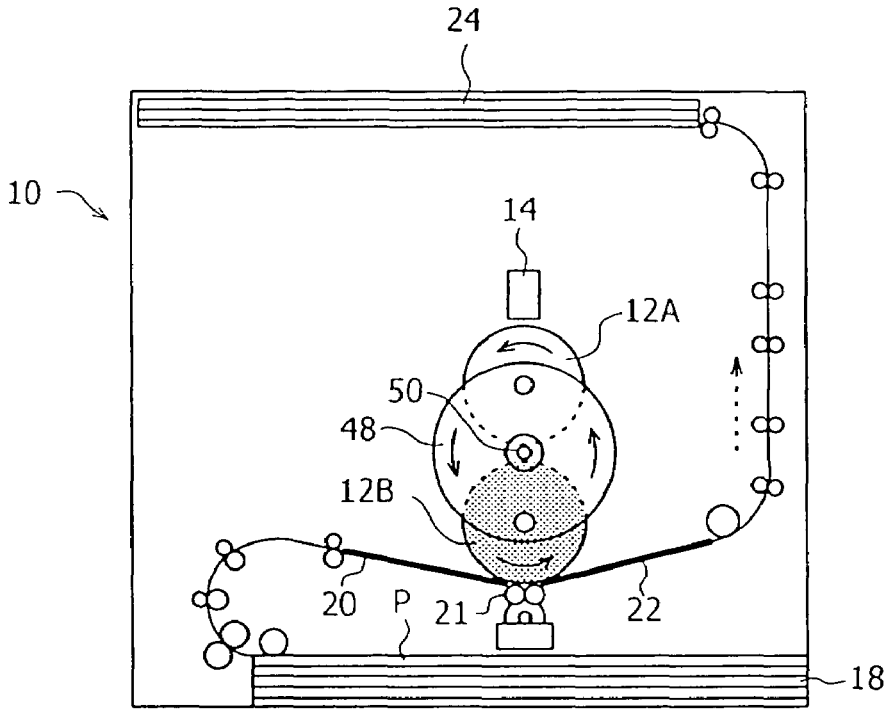
FIG. 1 is a side view of an image forming device according to the first embodiment of the present invention.

FIG. 1 illustrates an image forming device according to the first embodiment of the present invention.

As shown in FIG. 1, an image forming device 10 includes drums 12A, 12B on which the recording medium P is wound on the circumferences thereof and the printing processing is performed, a revolving unit 48 that supports rotating shafts of the drums 12 to be able to revolve about a revolving shaft 50 as the center, a recording medium feeding unit 18 that contains and feeds the recording medium P, a recording medium mounting unit 20 that winds the recording medium P on the circumferences of the drums 12, a head 14 that forms an image on the recording medium P wound on the drums 12, a recording medium peeling unit 22 that peels the recording medium P from the drums 12, and a recording medium stacking unit 24 that contains the recording medium P already printed.

The image forming device 10 also includes a head control unit that determines an ink-jet timing and elements (nozzles) to be used according to image signals and applies driving signals to the elements of the head 14, and a system control unit that controls the whole operation of the recording device, where the above control units are not illustrated.

Figure 2:
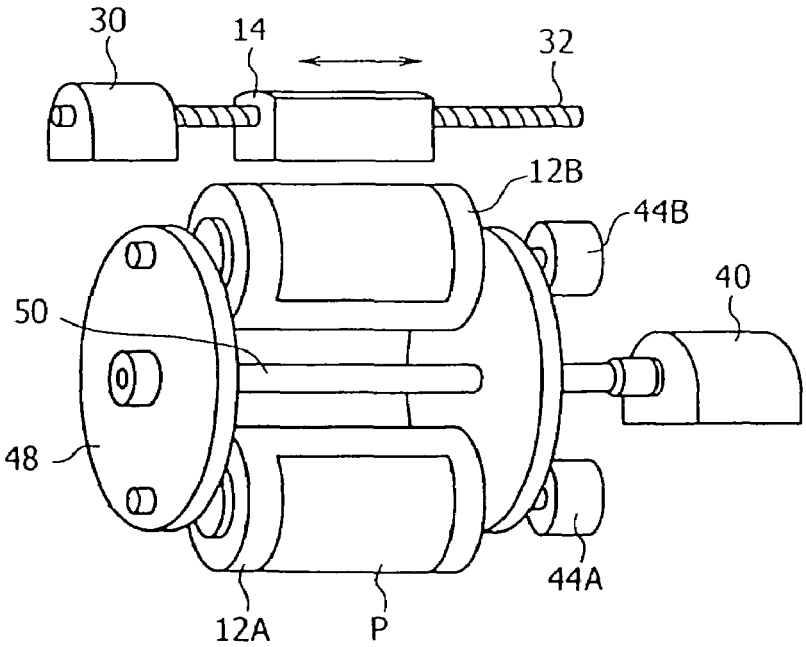
FIG. 2 is a perspective view illustrating the internal structure of the image forming device according to the first embodiment of the present invention.

FIG. 2 illustrates an image forming unit of the image forming device 10 according to the first embodiment of the present invention.

The drums 12A and 12B are supported by the revolving unit 48 as shown in FIG. 2. The drums 12A, 12B are driven to rotate by motors 44A, 44B, respectively, and are controlled to be able to vary the speeds individually. The revolving unit 48 is driven to revolve about the revolving shaft 50 as the center by a motor 40, which makes the drums 12A, 12B move to recording medium mounting/peeling position (the bottom in the drawing) and a printing position (the top in the drawing). The drums 12A, 12B wind or peel the recording medium P on the circumferences at the recording medium mounting/peeling position, and the head 14 performs image formation onto the wound recording medium P at the printing position.

Since the whole length of the head 14 covers the width of the recording medium P, the head 14 is able to scan the whole recording medium P by the rotation of the drums 12A, 12B only, without moving itself. Thereby, with one rotation of the drums 12A, 12B, the head 14 will form an image on the whole recording medium P.

As shown in FIG. 2, if a head traveling unit 32 is provided to support the head 14 so that the head 14 can travel in the width direction of the recording medium P with, partitioned printing will be possible, which will be described later.

The printing operation will be described.

The recording medium P contained in the recording medium feeding unit 18 in FIG. 1 is conveyed to the recording medium mounting unit 20, and is wound on the drum 12B on standby at the recording medium mounting position. A charging roll 21 presses the end of the recording medium P to the drum 12B, supplies charges onto the recording medium P, and makes the recording medium P generate adsorbability to the surface of the drum. The drum 12B rotates as the arrow in the drawing, and winds the recording medium P on the surface thereof. Here, the motor 44B that drives the drum 12B is driven at the rotating speed that is set to an optimum winding speed to the physical properties of the recording medium P. That is, the winding speed can be set according to the thickness, stiffness, and resilience of the recording medium P.

The drum 12B with the recording medium wound on the surface thereof halts the rotation, and moves to the printing position (upper part in the drawing) with the revolution of the revolving unit 48. The head 14 starts forming an image on the drum 12B according to the image signal. As the drum 12B rotates at the printing position, the head 14 scans the recording medium P wound on the surface of the drum 12B.

Since the length of the head 14 covers the width of the recording medium P, as shown in FIG. 2, the head 14 is able to scan the recording medium P by one rotation of the drum 12B. Here, the motor 44B that drives the drum 12B is driven by the rotation speed set to the optimum for the head 14 to form an image. That is, according to the image quality, by rotating the drum fast in the draft mode (high speed), and by rotating the drum slowly in the high image quality mode, the scanning speed of the head 14 can be set to the optimum.

As the drum 12B makes one rotation to complete forming an image on the recording medium P, the revolving unit 48 starts revolution again to move the drum 12B to the recording medium mounting position, namely, to the bottom.

The recording medium peeling unit 22 peels the recording medium P wound on the surface off the drum 12B at the recording medium peeling position, and the recording medium P is conveyed along the dotted arrow in FIG. 1. The conveyed recording medium P is delivered into the recording medium stacking unit 24.

The above operation will be described with the flowchart.

Figure 4:
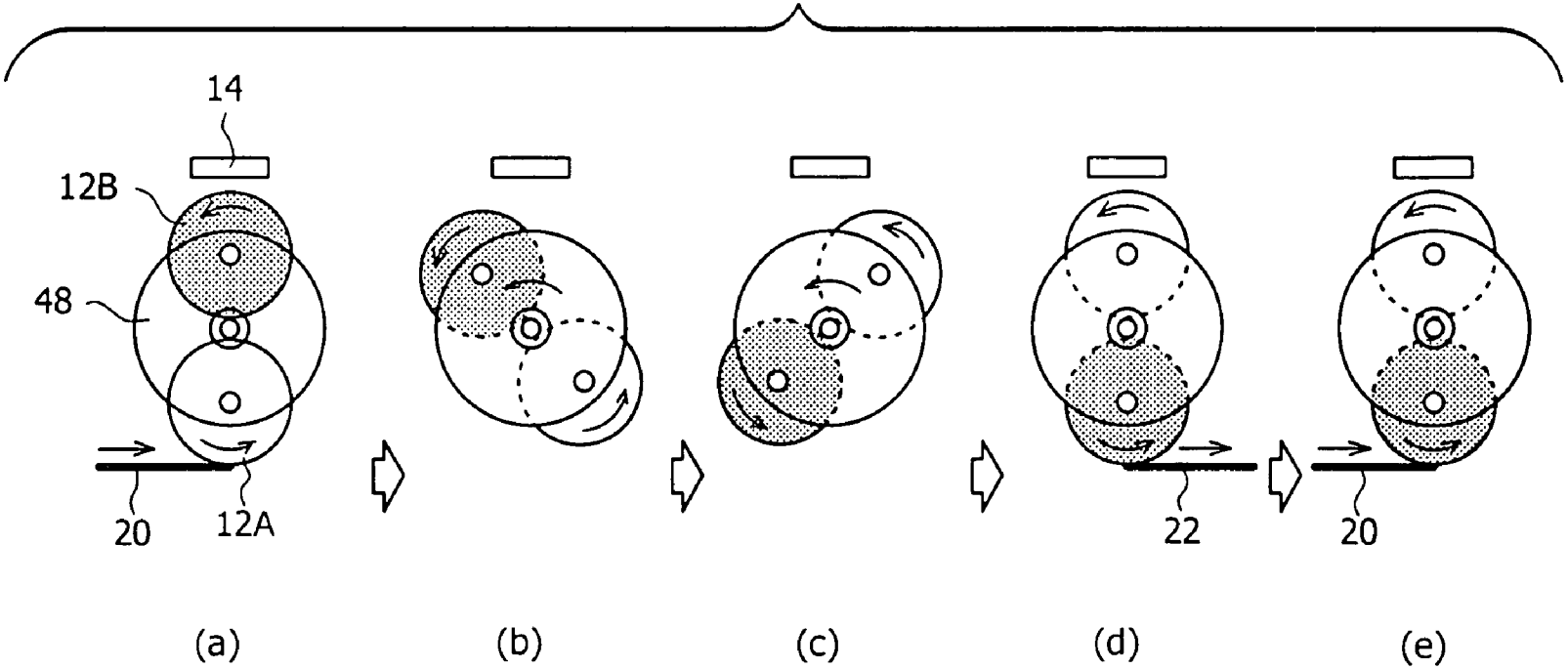
FIG. 4 is a side view illustrating the operation of the image forming device according to the first embodiment of the present invention.

FIG. 3 and FIG. 4 illustrate the operation of the image forming unit in the image forming device according to the first embodiment of the invention. The denotations (a) through (e) in FIG. 3 correspond to (a) through (e) in FIG. 4.

As shown in FIG. 3, as printing is started at the first step 100, the drums 12 are driven to rotate and are traveled to the start position at step 102. This position corresponds to the position indicated by the denotation (a) in FIG. 4. At this position, the recording medium P is mounted to the first drum 12A (step 104).

Next, at step 106 the revolving unit 48 rotates, and moves the first drum 12A to the printing position and the second drum 12B to the recording medium mounting/peeling position ((b) (c) in FIG. 4). While the first drum 12A with the recording medium P wound on the circumference thereof rotates, the head 14 forms an image ((d) in FIG. 4).

At step 110, it is judged whether the recording medium P on the first drum 12A is the first sheet, namely, whether the recording medium P is wound on the second drum 12B and the printing is made before this. If it is not the first one, the second drum 12B has the recording medium wound thereon, so the recording medium is peeled off at step 112 ((d) in FIG. 4). If the recording medium P on the first drum 12A is the first one, the drum 12B does not have the recording medium wound thereon, and the peeling operation will not be performed.

At the next step 114, it is judged whether the next page is not present, namely, whether the recording medium P on the first drum 12A is the last sheet. If it is the last one, after printing is completed at step 116, the revolving unit 48 rorates to move the first drum 12A to the recording medium mounting/peeling position at step 118. The recording medium P on the first drum 12A is peeled and the processing is completed (step 120).

If the next page is present at step 114, the processing advances to step 122, and the recording medium mounting unit 20 feeds the recording medium to the second drum 12B ((e) in FIG. 4). As the first drum 12A completes printing at step 124, the revolving unit 48 rotates to move the second drum 12B to the printing position (step 126).

The second drum 12B starts rotating at step 128, and the head 14 performs printing on the recording medium P. The processing thereafter repeats the same after step 108, and performs printing while the two drums 12 repeat rotation and revolution until the next page is judged not to be present at step 114 (134).

In this embodiment, the two drums 12A and 12B are alternately used, and while one of them performs the printing operation, the other can perform the mounting/peeling operation; thereby, the processing speed as the whole device can be enhanced. Further, the rotation speed of the drum can be varied in the printing operation and in the recording medium mounting/peeling operation, and stable mounting and peeling of the recording medium P can be performed accordingly. Further, the printed recording medium P on a standby drum at the recording medium mounting/peeling position is able to serve the time until the other drum in printing completes the printing as drying time, which gives an excellent drying characteristic to the recording medium P.

In the above embodiment, the electrostatic adsorption method is used for retaining the recording medium P; however, a vacuum method using a negative pressure or a mechanical method using a gripper may be used instead.

Figure 5A:
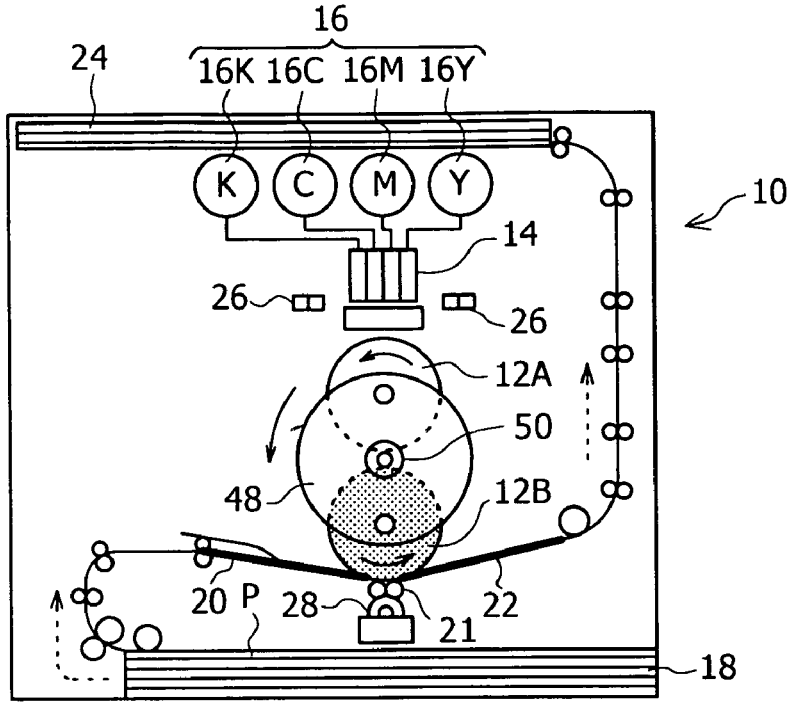
FIGS. 5A and 5B are side views of an image forming device according to the second embodiment of the present invention.
Figure 5B:
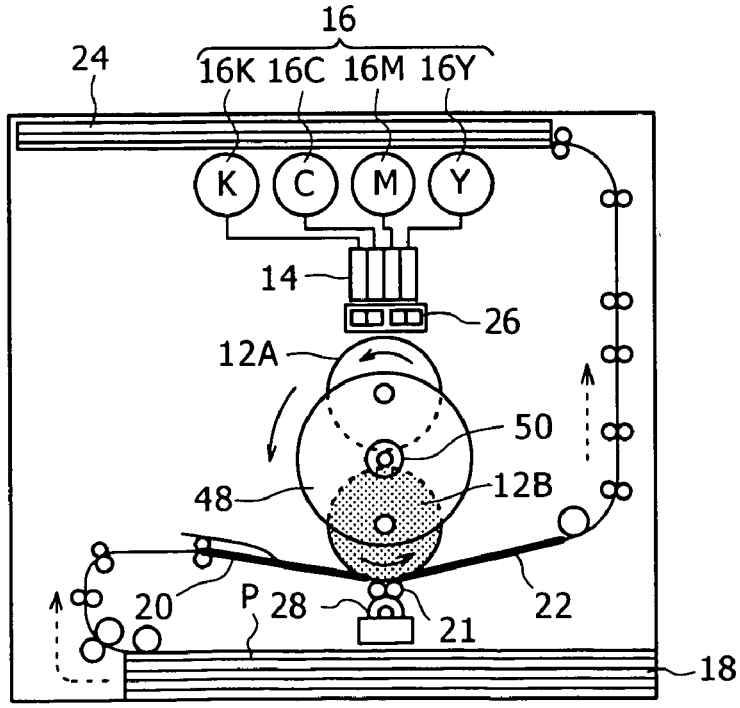
Figure 6:
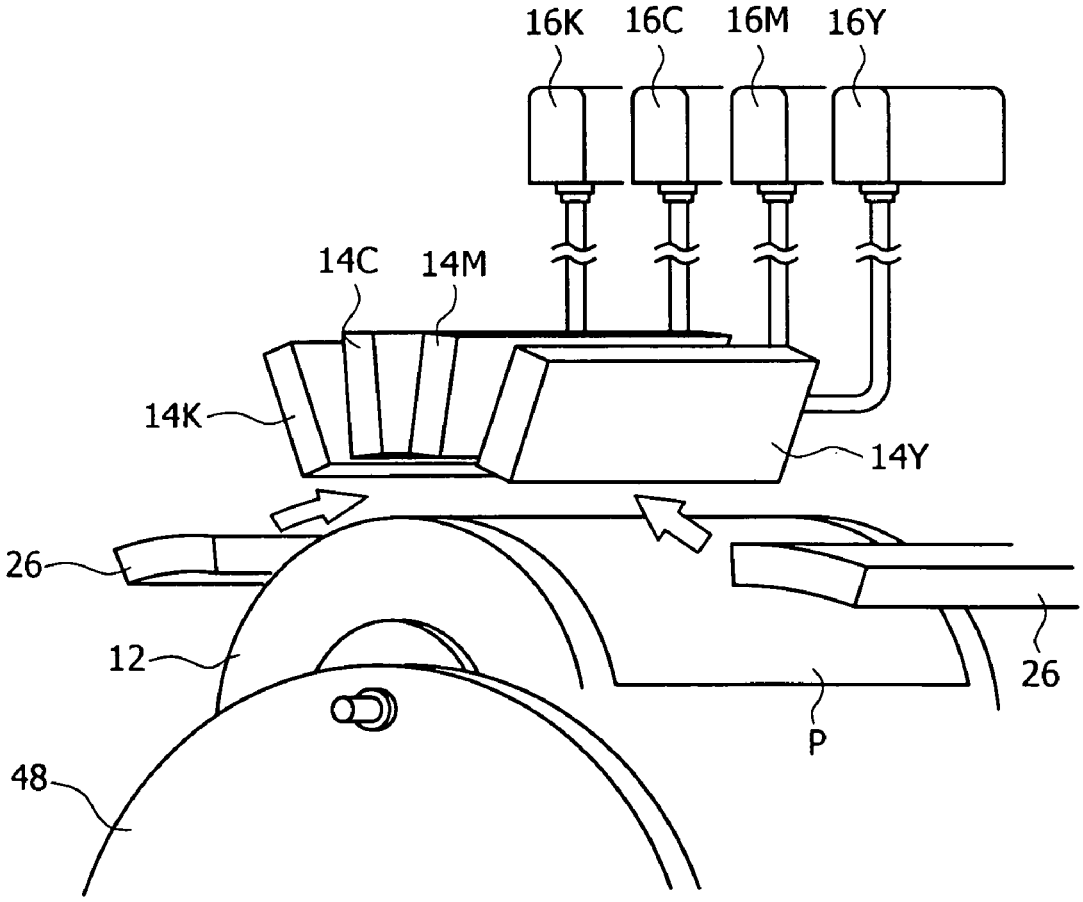
FIG. 6 is a perspective view illustrating the internal structure of the image forming device according to the second embodiment of the present invention.

FIGS. 5A, 5B and FIG. 6 illustrate an image forming device according to the second embodiment.

As shown in FIG. 5A, the image forming device 10 includes drums 12A, 12B on which the recording medium P is wound on the circumferences thereof and the printing processing is performed, a revolving unit 48 that supports rotating shafts of the drums 12 to be able to revolve about a revolving shaft 50 as the center, a recording medium feeding unit 18 that contains and feeds the recording medium P, a recording medium mounting unit 20 that winds the recording medium P on the circumferences of the drums 12, a head 14 that forms an image on the recording medium P wound on the drums 12, a maintenance unit 26 that performs maintenance of the head 14, a recording medium peeling unit 22 that peels the recording medium P off the drums 12, a recording medium stacking unit 24 that contains the recording medium P already printed, and a drum maintenance unit 28 that cleans the circumferences of the drums 12.

As shown in FIG. 6, the head 14 forms in a head array, in which four color heads 14Y to 14K covering the recording medium width are placed in parallel to face the circumference of the drum 12 located at the printing position, and forms an image on the recording medium P retained on the circumference of the drum 12 located at the printing position. The head 14 includes a unit that moves the head off the drums 12 at the printing position. Thereby, the head 14 moves to a position where the head 14 is not obstruction to the operations during the revolution and maintenance of the drum. The four color heads 14Y to 14K are coupled to ink tanks 16Y to 16K, respectively, and respective color-inks are supplied. The heads can use various types of inks, such as water based ink, oil based ink, or solvent based ink.

As the drum 12 makes only one rotation, the four color heads 14Y to 14K scan and print on the recording medium P, and form full-color images from the four colors at a high speed. The driving method of the head 14 can be selected in relation to the ink to be used and/or the throughput of the device, among the thermal method, the piezoelectric method and so forth.

As shown in FIG. 5B, the maintenance unit 26 is movably supported at a position facing to the nozzle face of the head 14 (the opposing face to the drum 12). The maintenance unit 26 withdraws to a position where it is not obstruction to the printing operation and the revolution of the drum during printing, as shown in FIG. 5A. As the printing is completed, or before the printing is performed, the maintenance unit 26 moves to the position as shown in FIG. 5B. When there are plural heads 14 as shown in FIG. 5A, the maintenance unit 26 may be arrayed in two places with two colors each, for example. Also, a construction may be made such that the head 14 moves in a direction to depart from the drum 12 during maintenance, and the maintenance unit 26 is moved in between the drum 12 and the head 14.

The maintenance unit 26 is made up with a dummy jet bracketing member, a wiping member, and a cap member and so forth. The maintenance unit 26 performs a dummy jet bracketing operation that prevents the dummy jet for preventing the choking of the nozzles from smearing the inside of the unit, a wiping operation that cleans the nozzle faces of the head 14, and a capping operation that prevents dried inks from choking the nozzle openings of the head 14 and so forth.

Before the recording medium P is wound on the surface of the drum 12 at the recording medium mounting/peeling position, or after the recording medium P is peeled, the drum maintenance unit 28 comes in contact with the surface of the drum 12 located at the recording medium mounting/peeling position, and cleans the circumference by using the rotation of the drum 12. This will keep the circumference of the drum 12 coming in contact with the recording medium P always clean from ink smears and paper powders and so forth.

Figure 7A:
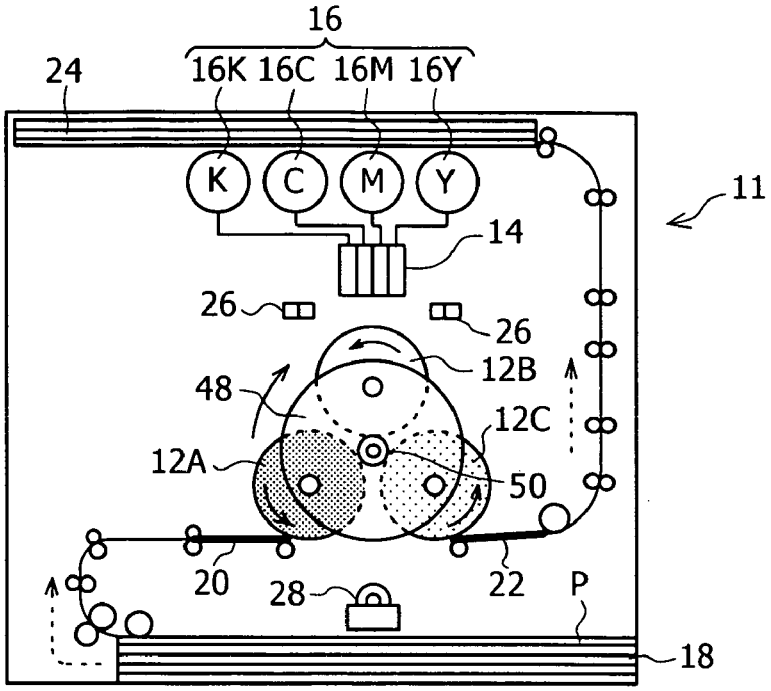
FIGS. 7A and 7B are side views of an image forming device according to the third embodiment of the present invention.
Figure 7B:
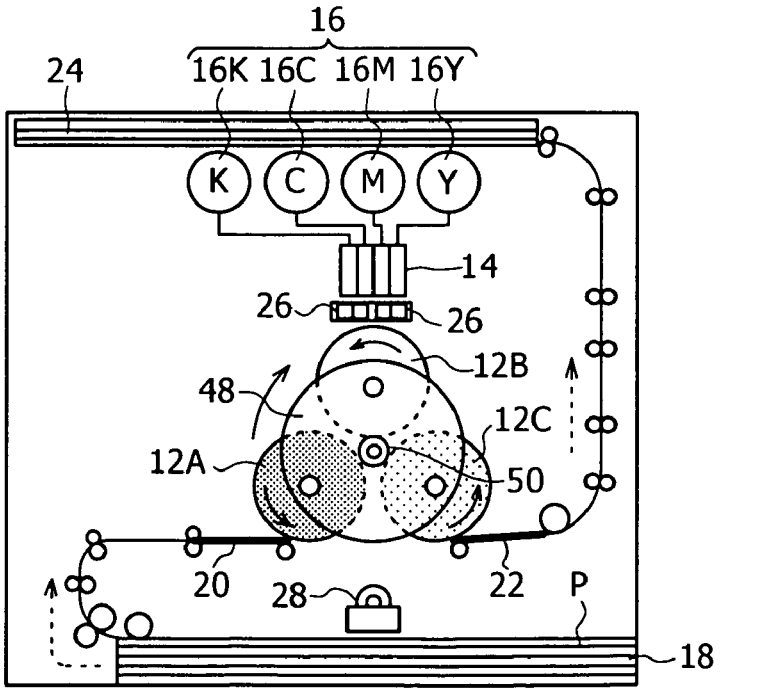

FIGS. 7A and 7B illustrate an image forming device according to the third embodiment of the invention.

As shown in FIGS. 7A and 7B, the image forming device 11 includes three drums 12A, 12B, and 12C on which the recording medium P is wound on the circumferences thereof and the printing processing is performed, a revolving unit 48 that supports rotating shafts of the drums 12 to be able to revolve about a revolving shaft 50 as the center, a recording medium feeding unit 18 that contains and feeds the recording medium P, a recording medium mounting unit 20 that winds the recording medium P on the circumferences of the drums 12, a head 14 that forms an image on the recording medium P wound on the drums 12, a maintenance unit 26 that performs maintenance of the head 14, a recording medium peeling unit 22 that peels the recording medium P off the drums 12, a recording medium stacker unit 24 that contains the recording medium P already printed, and a drum maintenance unit 28 that cleans the circumferences of the drums 12.

The structure of the head 14 is the same as that of the second embodiment. As shown in FIG. 6, the head 14 forms in a head array, in which four color heads 14Y to 14K covering the recording medium width are placed in parallel to face the circumference of the drum 12, and forms an image on the recording medium P retained on the circumference of the drum 12. The head 14 includes a unit that moves the head off the drum 12 at the printing position. Thereby, the head 14 moves to a position where the head 14 is not an obstruction to the operations during the revolution and maintenance of the drum. The four color heads 14Y to 14K are coupled to ink tanks 16Y to 16K, respectively, and respective color-inks are supplied.

As the drum 12 makes only one rotation, the four color heads 14Y to 14K scan and print on the recording medium P, and form full-color images from the four colors at a high speed, which is the same as the second embodiment.

The operation of the maintenance unit 26 is also the same as the second embodiment. That is, as shown in FIG. 7B, the maintenance unit 26 is movably supported at a position facing to the nozzle face of the head 14 (the opposing face to the drum 12). The maintenance unit 26 withdraws to a position where it is not obstruction to the printing operation and the revolution of the drum during printing, as shown in FIG. 7A. As the printing is completed, or before the printing is performed, the maintenance unit 26 moves to the position as shown in FIG. 7B. When there are plural heads 14 as shown in FIG. 7A, the maintenance unit 26 may be arrayed in two places with two colors each, for example. Also, a construction may be made such that the head 14 moves in a direction to depart from the drum 12 during maintenance, and the maintenance unit 26 is moved in between the drum 12 and the head 14.

At the middle position between the recording medium peeling position and the recording medium mounting position, the drum maintenance unit 28 comes in contact with the surfaces of the drum 12, and cleans the circumferences of the drum 12 by using the rotation of the drum 12. This will keep the circumferences of the drum 12 coming in contact with the recording medium P always clean from ink smears and paper powders and so forth.

Since the drums 12 are not right beneath the head 14 at this moment, and there is comparably a large margin beneath the head 14, the maintenance unit 26 may be moved right beneath the head 14 at this timing to perform the maintenance.

Figure 9:
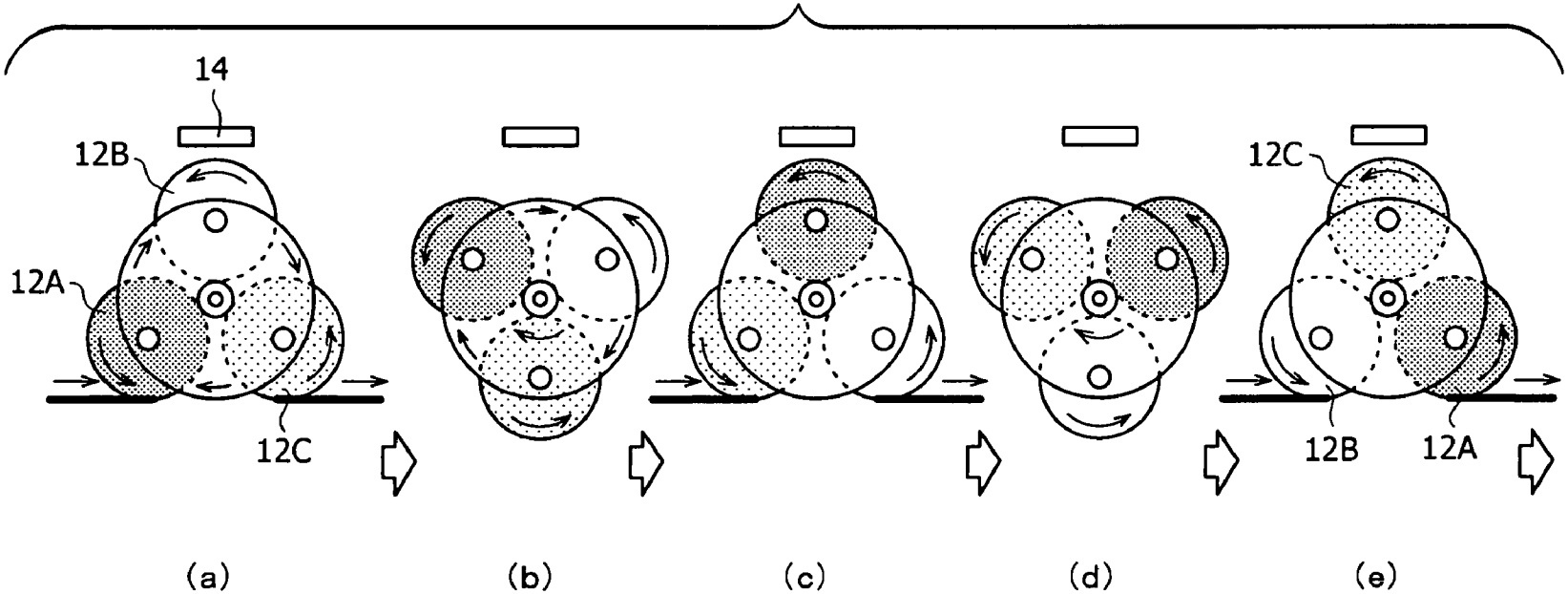
FIG. 9 is a side view illustrating the operation of the image forming device according to the third embodiment of the present invention.

FIG. 8 and FIG. 9 illustrate the operation of the image forming unit in the image forming device according to the third embodiment of the invention. The denotations (a) through (e) in the flowchart of FIG. 8 correspond to (a) through (e) in FIG. 9.

As shown in FIG. 8, as printing is started at the first step 200, the drums 12 are driven to rotate and are traveled to the start position at step 202. This position corresponds to the position indicated by the denotation (a) in FIG. 9. At this position, the recording medium P is supplied to the first drum 12A (step 204).

Next, at step 208 the revolving unit 48 rotates t o move the first drum 12A to the printing position, the second drum 12B to the recording medium peeling position, and the third drum 12C to the recording medium mounting position ((b) in FIG. 9)

While the first drum 12A with the recording medium P wound on the circumference thereof rotates, the head 14 forms an image ((c) in FIG. 9).

Next, at step 212, it is judged whether the recording medium P on the first drum 12A is the first sheet, namely, whether the recording medium P has been wound on the second drum 12B and the printing has been made before this. If it is not the first one, the second drum 12B has the recording medium wound thereon, so the recording medium is peeled off at step 214 ((c) in FIG. 9). If the recording medium P on the first drum 12A is the first one, the drum 12B does not have the recording medium wound thereon, and the peeling operation will not be performed.

At step 216, it is judged whether the next page is not present, namely, whether the recording medium P on the first drum 12A is the last sheet. If it is the last one, after printing is completed at step 218, the revolving unit 48 rotates to move the first drum 12A to the recording medium peeling position at step 220. The recording medium P on the first drum 12A is peeled and the processing is completed (step 222).

If the next page is present at step 216, the processing advances to step 224, and the recording medium mounting unit 20 feeds the recording medium to the third drum 12C ((c) in FIG. 9). As the first drum 12A completes printing at step 226, the revolving unit 48 rotates to move the first drum 12A to the recording medium peeling position, the second drum 12B to the recording medium mounting position, and the third drum 12C to the printing position (step 228, (d) in FIG. 9).

The third drum 12C starts rotating at step 230, and the head 14 performs printing to the recording medium P ((e) in FIG. 9).

At the following step 232, it is judged whether the recording medium P on the third drum 12C is the first sheet, namely, whether the recording medium P has been wound on the first drum 12A and the printing has been made before this. At this stage, however, the printing has already been made on the recording medium P on the first drum 12A; accordingly, the processing advances to step 234, and the first drum 12A peels the printed recording medium (when started after the next time, and if the first drum 12A does not come to the recording medium mounting position, there will be a possibility that the processing branches at step 232).

At the next step 236 it is judged whether the next page is present or not, namely, whether the recording medium P on the third drum 12C is the last sheet. If it is the last one, after printing is completed at step 238, the revolving unit 48 rotates to move the third drum 12C to the recording medium peeling position at step 240. The recording medium P on the third drum 12C is peeled and the processing is completed (step 242).

If the next page is present at step 236, the processing advances to step 244, and the recording medium mounting unit 20 feeds the recording medium to the second drum 12B ((e) in FIG. 9). As the third drum 12C completes printing at step 246, the revolving unit 48 rotates to move the first drum 12A to the recording medium mounting position, the second drum 12B to the printing position, and the third drum 12C to the recording medium peeling position (step 248).

Thereafter, the mounting process, printing process and peeling process are repeated in the same manner, while the first drum 12A through the third drum 12C are sequentially replaced. These processes are repeated until the judgment at any of steps 216, 236, and 256 determines that the next page is the last page.

This embodiment uses three drums 12A, 12B, and 12C alternately, and while one drum is in the printing operation, another drum comes into the recording medium mounting operation, and yet another one comes into the recording medium peeling operation; accordingly, this embodiment is able to enhance the processing speed as the whole device, as compared with the first embodiment using two drums. It is also possible to adjust the rotating speed of the drum to the ideal value on each process of the mounting, printing and peeling process, so that this embodiment serves for stable mounting and peeling of the recording medium P. Further, the printed recording medium P on a standby drum at the recording medium peeling position is able to serve the time until the other drum on printing completes the printing as drying time, which gives an excellent drying characteristic to the recording medium P.

In the above embodiment, the electrostatic adsorption method is used for retaining the recording medium P; however, a vacuum method using a negative pressure or a mechanical method using a gripper may be used instead, which is the same as the first embodiment.

Figure 10A:
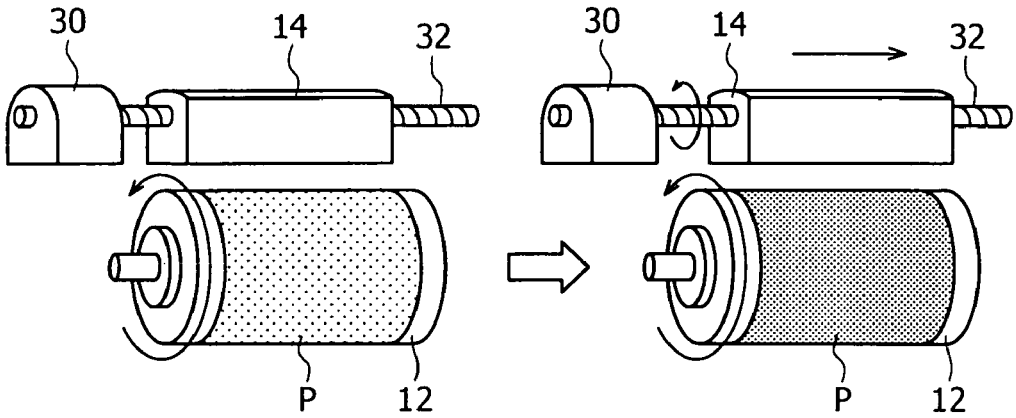
FIG. 10A is a side view of an image forming device according to the forth embodiment of the present invention.
Figure 10B:
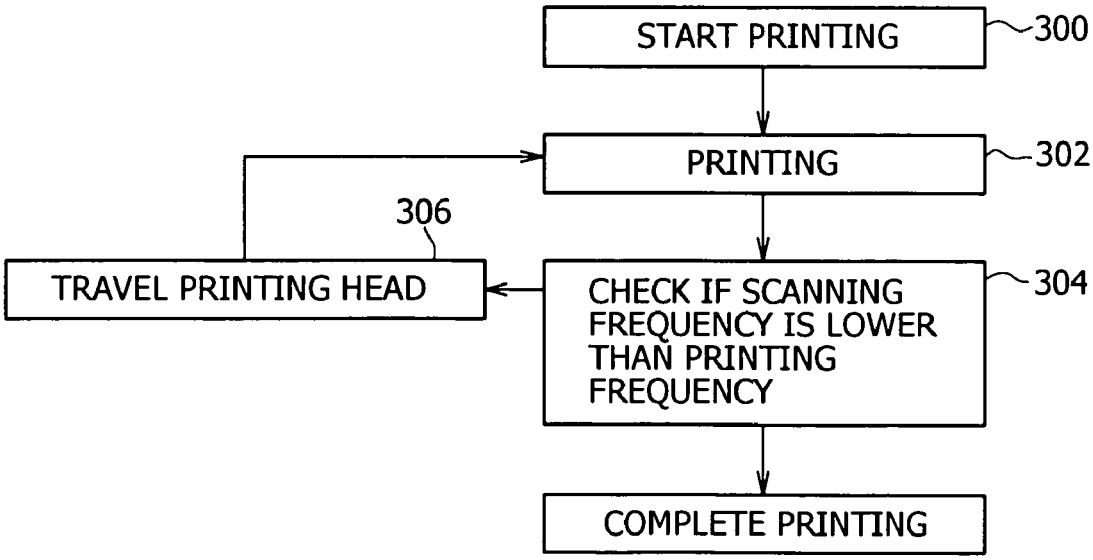
FIG. 10B is a flowchart illustrating the operation thereof.

FIGS. 10A and 10B illustrate the operation of an image forming device according to the forth embodiment of the invention.

As shown in FIG. 10A, since the head 14 covers the width of the recording medium P when the drum 12 performs printing with the recording medium P wound thereon, the printing is completed with one stroke of scanning.

Here, if the head 14 is movably supported in the recording medium width direction by a motor 30 and a head traveling unit 32, it will be possible to move the head 14 after completing one stroke of scanning, and rescan and record an image on the recording medium P to be overlapped.

As shown in FIG. 10B, the printing operation having started at step 300 temporally terminates the scanning at step 302. If the scanning frequency at this moment is lower than the printing frequency preset at step 304, the head 14 is moved by a predetermined quantity at step 306, and the processing returns to step 302, and the printing operation is started again.

Repeating the above processing will repeat the printing by a set frequency. Here, the printing is made while moving the head 14, which makes it possible to form dots at slightly shifted places on the recording medium P. This enables the so-called partitioned printing. By performing the printing several times while shifting the head 14 by a distance that does not come to the integral multiple of the nozzle spacing of the head 14 that forms dots, it becomes possible to shrink the spacing of the dots against the nozzle spacing of the head 14, thus achieving high-definition images.

This embodiment adopts a construction that employs the head 14 covering the width of the recording medium P and performs high-speed repetitive scanning with the recording medium P wound on the drum 12, which achieves high-speed partitioned printing.

Figure 11:
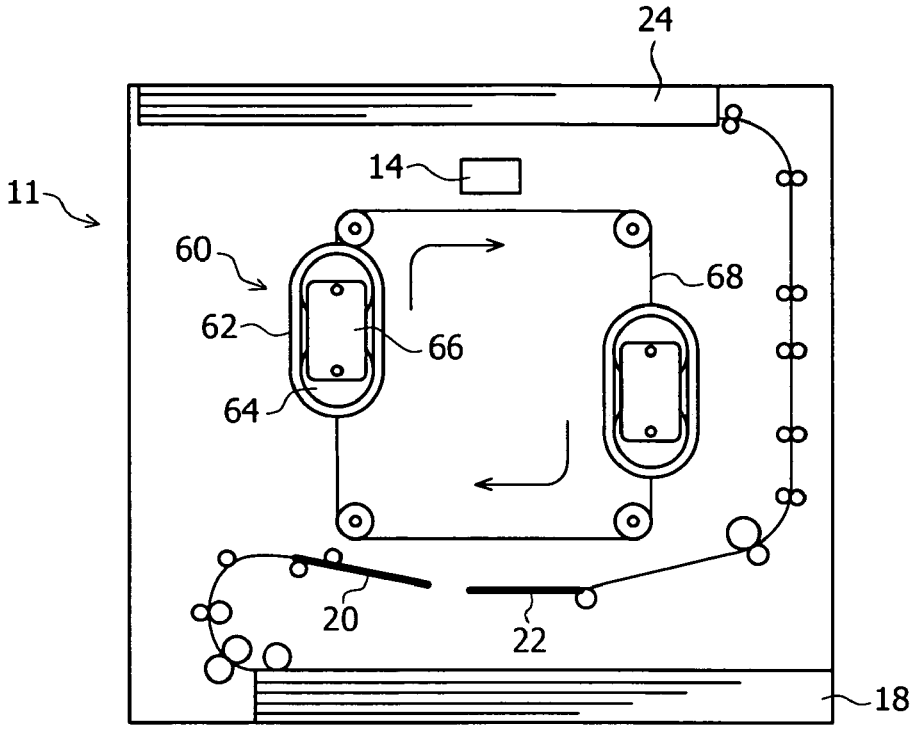
FIG. 11 is a side view of an image forming device according to the fifth embodiment of the present invention.
Figure 12:
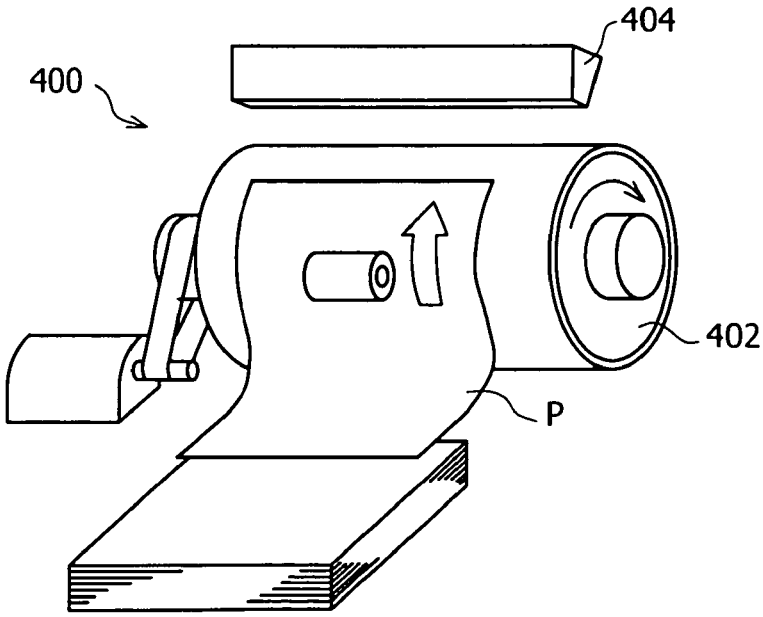
FIG. 12 (RELATED ART)
FIG. 12 is a perspective view illustrating the structure of a conventional image forming device.

FIG. 11 illustrates an image forming device according to the fifth embodiment of the invention.

As shown in FIG. 11, the image forming device 11 includes retaining units 60 that perform printing with the recording medium P wound on the circumferences thereof and a loop path 68 on which the retaining units 60 are forwarded. One of the retaining units 60 located at the printing position right beneath the head 14 performs printing on the recording medium P wound thereon, and the other retaining unit 60 performs recording medium mounting/peeling at the recording medium mounting/peeling position (the lower part in the drawing).

The retaining unit 60 includes roller pairs 64 with a loop-formed recording medium retaining belt 62 wound thereon and a frame 66 that bears the roller pairs 64, and is forwarded on the loop path 68. The retaining unit 60 also contains a motor, which is not illustrated. The motor rotates the roller pairs 64 to drive the recording medium retaining belt 62. Thus, the retaining unit 60 performs the recording medium mounting, printing and peeling operations to the recording medium P.

The mechanism for forwarding the recording medium retaining unit 60 on the loop path 68 may be a driving device that is incorporated in the recording medium retaining unit 60 itself. Or, an external motor using a roller chain and a timing belt may be employed for forwarding the recording medium retaining unit 60.

This embodiment employs the recording medium retaining belt in replacement for the drum, which makes it possible to freely design the shape of the retaining unit, as compared to the cylindrical drum. It is also possible to make the shape of the loop path in various forms so as to match the internal structure of the device.

The present invention with the above construction embodies a high-speed and stable FWA ink-jet image recording device.

Further, it is also conceivable to provide the revolving unit with a counter weight for reducing vibrations by the revolutions of the drums, and heighten the revolving speed for a higher processing speed. It is also conceivable to set the recording medium mounting and recording medium peeling timings outside the printing time, in order that the vibrations generated by the recording medium mounting and recording medium peeling do not cause any influences over the printing quality.

As described above, according to an embodiment of the invention, the image recording device includes plural retaining units each of which retains a recording medium on circumferences thereof, a printing head that forms an image on the recording medium, a loop unit that retains the plural retaining units on a closed path, a first driving unit that drives each of the plural retaining units, and a second driving unit that conveys the retaining units on the loop unit. When the first driving unit drives one of the retaining units to form an image on a first recording medium retained on circumference thereof, the first driving unit drives another one of the retaining units to mount a second recording medium on circumference thereof, and the second driving unit conveys one of the retaining units to a recording medium peeling position after completing image formation, and another one of the retaining units to a printing position.

In the construction according to this embodiment of the invention, the plural the retaining units each of which retains a recording medium on the circumferences thereof are used alternately or in a sequential order, and while one retaining unit is on printing, another one of the retaining units is made to perform recording medium mounting operation or/and recording medium peeling operation. Thereby, it is possible to reduce a loss time resulting from that the printing cannot be performed during recording medium mounting or recording medium peeling.

According to another embodiment of the invention, the image recording device includes two drums each of which retains recording medium on circumferences thereof, each of which is rotatably supported, a printing head that forms an image on the recording medium, a revolving unit that retains rotating shafts of the two drums on circumferences thereof, a first driving unit that drives to rotate the two drums, and a second driving unit that drives to rotate the revolving unit. When the first driving unit rotates one of the two drums to form an image on a first recording medium retained on circumference thereof, the first driving unit rotates the other drum to mount a second recording medium on circumference thereof, and the second driving unit rotates one of the drums to a recording medium peeling position after completing image formation, and the other drum to a printing position.

In the construction according to this embodiment of the invention, the drums that retain the recording medium on the circumferences thereof are used alternately, and while one drum is on printing, the other drum is made to perform recording medium mounting or peeling operation. Thereby, it is possible to reduce a loss time resulting from recording medium mounting or recording medium peeling. Further, the construction employs the drums as the retaining mechanism, which allows still stabler retention of the recording medium compared to the conveyance system using a belt and so forth, because the wrinkles and meanders of the belt are less likely to be produced.

According to another embodiment of the invention, the image recording device includes three drums (first drum, second drum, and third drum) each of which retains a recording medium on circumference thereof, each of which is rotatably supported, a printing head that forms an image on the recording medium, a revolving unit that retains rotating shafts of the three drums on circumferences thereof, first driving unit that drives to rotate the three drums, and a second driving unit that drives to rotate the revolving unit. When the first driving unit rotates the first drum to form an image on a first recording medium, the first driving unit rotates the second drum to mount a second recording medium on circumference thereof, and rotates the third drum to peel a third recording medium, and the second driving unit rotates the first drum to a recording medium peeling position after completing image formation, the second drum to a printing position, and the third drum to a recording medium mounting position.

In the construction according to this embodiment of the invention, the drums that retain the recording medium on the circumferences thereof are used in a sequential order, and while one drum is on printing, another is made to perform recording medium mounting operation, and the remaining one is made to perform recording medium peeling operation. Thereby, it is possible to reduce a loss time resulting from recording medium mounting or recording medium peeling.

According to another embodiment of the invention, a driving speed of the first driving units may be variable.

In the construction according to this embodiment of the invention, it is possible to perform stable recording medium mounting/peeling by varying the driving speed during printing and recording medium mounting/peeling operations, and it is also possible to perform efficient processing to match with the types of the recording medium and the image quality modes.

The present invention, having adopted aforementioned construction, realizes the FWA ink-jet image recording device that performs high-speed printing with stable printing quality.

The foregoing description of the embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

The entire disclosure of Japanese Patent Application No. 2004-262580 filed on Sep. 9, 2004 including specification, claims, drawings and abstract is incorporated herein by reference in its entirety.

What is claimed is:

1. An image recording device comprising:

a plurality of retaining units each of which retains a recording medium on circumference thereof, a printing head that forms an image on the recording medium, a loop unit that retains the plurality of retaining units on a closed path, a first driving unit that drives each of the plurality of retaining units, and a second driving unit that conveys the retaining units on the loop unit, wherein when the first driving unit drives one of the plurality of retaining units to form an image on a first recording medium retained on circumference thereof, the first driving unit drives another one of the retaining units to mount a second recording medium on circumference thereof, and the second driving unit conveys one of the retaining units to a recording medium peeling position after completing image formation, and another one of the retaining units to a printing position.

2. The image recording device according to claim 1, wherein the driving speed of the first driving unit is variable.

3. An image recording device comprising:

two drums each of which retains a recording medium on circumference thereof, each of which is rotatably supported, a printing head that forms an image on the recording medium, a revolving unit that retains rotating shafts of the two drums on circumference thereof, which is rotatable, a first driving unit that drives to rotate the two drums, and a second driving unit that drives to rotate the revolving unit, wherein when the first driving unit rotates one of the two drums to form an image on a first recording medium retained on circumference thereof, the first driving unit rotates the other drum to mount a second recording medium on circumference thereof, and the second driving unit rotates one of the drums to a recording medium peeling position after completing image formation, and the other drum to a printing position.

4. An image recording device comprising:

three drums: a first drum, a second drum and a third drum, each of which retains a recording medium on circumference thereof, each of which is rotatably supported, a printing head that forms an image on the recording medium, a revolving unit that retains rotating shafts of the three drums on circumference thereof, which is rotatable, a first driving unit that drives to rotate the three drums, and a second driving unit that drives to rotate the revolving unit, wherein when the first driving unit rotates the first drum to form an image on a first recording medium retained on circumference thereof, the first driving unit rotates the second drum to mount a second recording medium on circumference thereof, and rotates the third drum to peel a third recording medium, and the second driving unit rotates the first drum to a recording medium peeling position after completing image formation, the second drum to a printing position, and the third drum to a recording medium mounting position.

* * * * *